United States Patent [19]

Becker et al.

[11] 4,448,263

[45] May 15, 1984

[54] DRILLING APPARATUS

[75] Inventors: Kunibert Becker, Werl; Rudiger Kirchbrucher, Dortmund-Brackel; Burckhard Elsner, Lunen, all of Fed. Rep. of Germany

[73] Assignee: Gewerkschaft Eisenhutte Westfalia, Lunen, Fed. Rep. of Germany

[21] Appl. No.: 324,462

[22] Filed: Nov. 24, 1981

[30] Foreign Application Priority Data

Nov. 29, 1980 [DE] Fed. Rep. of Germany ..... 3045047

[51] Int. Cl.[3] ..... E21C 11/00

[52] U.S. Cl. ..... 173/34; 173/43

[58] Field of Search ..... 173/34, 43; 299/33; 104/94, 106; 105/155

[56] References Cited

U.S. PATENT DOCUMENTS

| | | | |
|---|---|---|---|
| 1,810,417 | 6/1931 | Francis | 105/155 X |
| 3,310,003 | 3/1967 | Bryan | 104/94 |
| 3,458,396 | 7/1969 | Grant | 173/43 X |
| 3,471,888 | 10/1969 | Grant et al. | 173/34 X |
| 3,731,976 | 5/1973 | Granskog | 299/18 |
| 3,828,862 | 8/1974 | Dabell et al. | 173/43 |
| 4,095,306 | 6/1978 | Norton | 173/43 X |
| 4,346,766 | 8/1982 | Manten | 173/43 |

FOREIGN PATENT DOCUMENTS

| | | |
|---|---|---|
| 1955355 | 11/1970 | Fed. Rep. of Germany . |
| 2208710 | 9/1973 | Fed. Rep. of Germany . |
| 2705460 | 8/1978 | Fed. Rep. of Germany . |

*Primary Examiner*—James M. Meister

*Attorney, Agent, or Firm*—Thompson, Birch

[57] ABSTRACT

A mineral mining installation comprises a mine roof support assembly and apparatus for drilling bores. The roof support assembly comprises a plurality of roof support units positioned side-by-side, and the drilling apparatus comprises a drilling device which is movably guided on a track associated with the roof support assembly. Each of the roof support units has at least one roof bar. The track is arranged on the underneath sides of the roof bars of the roof support units. The drilling device is pivotally mounted on a trolley which is movably guided on the track.

20 Claims, 6 Drawing Figures

DRILLING APPARATUS

BACKGROUND TO THE INVENTION

This invention relates to a drilling apparatus for drilling bores in mine workings or roadways.

In underground mines, it is known to secure mine installations (such as the roof support units of a roof support assembly) by means of roof anchors. Similarly, gap sealing strips (which are used to seal the gaps between the roof bars of adjacent roof support units) can be secured by means of roof anchors. In each case, the roof anchors are firmly secured in bores drilled in the roof of the working or roadway supported by the roof support assembly. It is also known to drill bores in the mineral face of a mine working, the bores being used to house explosive for use in winning mineral material by explosive blasting. Typically, explosive blasting is used to win mineral material from the upper region of a mineral face (or seam); the lower region being won by a mechanical winning machine (such as a plough or a shearer), which is driven to and fro along the face side of a conveyor positioned in front of the face, and within the protection of the roof support assembly. For this purpose, bores are drilled through apertures in the roof bars of the roof support units. (See DE-OS No. 2 705 460 published Aug. 17, 1978).

In order to drill such bores, it is essential to use a drilling machine that can be supported, and made fast, in any desired drilling position. One known way of doing this is to fix the drilling machine to, for example, a roadway driving machine (See DE-AS No. 2 208 710 published Sept. 13, 1973). Obviously, this fixing method is no use for drilling bores along a line of roof support units positioned in a longwall working or a roadway.

It is also known to arrange a drilling machine on the roof support assembly itself (See DE-OS No. 1 955 355 published Nov. 19, 1970). In this case, vertically-movable carrier arms are guided on a pair of props of the assembly. The props are interconnected by a transverse roof bar, and the arms are interconnected by a transverse guide rail. A drilling machine is supported and guided on the transverse guide rail. This type of drilling apparatus has a number of disadvantages. In particular, the guide rail extends over the entire width of the roadway (or working), and lies a substantial distance below the roof bars of the roof support assembly. Thus, the access area defined by the assembly is considerably restricted. Moreover, owing to the rigid guidance of the drilling machine on the guide rail, adjustment of the drilling angle is impossible. Furthermore, the advance mechanism, which is required to force the drill bit forward as drilling proceeds, is constituted by means for lifting the entire guide rail together with its carrier arms. This lifting means comprises separate lifting devices for each of the carrier arms. Consequently, it is not possible to drill bores in the side walls of a roadway, or in the face of a longwall working.

The object of the invention is to produce a drilling apparatus which can be used with an advanceable mine roof support assembly, which can drill bores in both roof and side walls, which can drill bores at different angles, and which is of relatively simple and space-saving construction.

SUMMARY OF THE INVENTION

The present invention provides in a mineral mining installation for use in an underground mine, the installation comprising a mine roof support assembly and apparatus for drilling bores, the roof support assembly comprising a plurality of roof support units positioned side-by-side, and the drilling apparatus comprising a drilling device which is movably guided on a track associated with the roof support assembly, each of the roof support units having at least one roof bar, the improvements comprising arranging the track on the roof bars of the roof support units, and pivotally mounting the drilling device on a trolley which is movably guided on the track.

By positioning the track on the underneath sides of the roof bars, the available working space (access area) defined by the assembly is not unduly restricted by the track. Moreover, the drilling device can be moved, with the trolley, along the track so as to position the drilling device at any desired position. Furthermore, the pivotal mounting of the drilling device on the trolley enables drilling ot occur at different angles.

Advantageously, the drilling device is pivotally mounted on the trolley for pivotal movement about an axis which is parallel to the longitudinal axis of the track, and/or for pivotal movement about an axis which lies at right-angles to said longitudinal axis and in the plane of the track. Thus, the drilling device can be used to drill bores in the roof or in the side walls of a roadway or working. Of course, it is possible to arrange several drilling devices on the track, so that several bores can be drilled simultaneously.

The pivotal mounting of the drilling device also enables roof bores to be drilled at angles of up to about 30° to the vertical. Similarly, bores can be drilled in a face or roadway side wall at oblique angles.

In a preferred embodiment, the trolley is mounted on a beam which is movably guided on the track. Preferably, the beam is provided with rollers for movably guiding the beam on the track. In this case, the beam may be of hollow box-shape construction, the base of which is formed with a longitudinally-extending slot, and the trolley may be provided with rollers which rollingly engage with the internal surface of the slotted base of the beam, whereby the trolley is movable relative to the beam. In this way, it is possible to adjust the position of the drilling device very accurately, since both the beam and the trolley are movable with respect to the track. Moreover, the range of possible drilling positions is increased, since the beam can be moved partially out of the end portions of the track, so that the trolley can be positioned so as to align the drilling device beyond the end roof bars of the assembly. Consequently, drilling is possible along the entire length of the assembly. The provision of the rollers on both the trolley and the beam enables the trolley and/or the beam to be displaced by hand, so that a separate drive is not required.

Advantageously, means are provided for adjusting the position of the drilling device relative to the trolley. Preferably, a hydraulic ram pivotally mounted between the trolley and the drilling device comprises said adjusting means.

Means may be provided for securing the trolley to the beam, and for securing the beam to the track. Advantageously, respective securing devices are provided for securing the trolley to the beam, and for securing the beam to the track.

Preferably, the drilling device is provided with a support which is extensible so as to contact the mine floor, thereby providing an abutment for the drilling device.

Advantageously, the drilling device comprises a casing, a carrier mounting within the casing, a drill mounted on the carrier mounting for reciprocal movement therealong, and means for moving the drill with respect to the carrier mounting. Preferably, a hydraulic ram comprises the means for moving the drill with respect to the carrier mounting, said hydraulic ram being arranged within the casing of the drilling device.

The invention also provides a mineral mining installation for use in an underground mine, the installation comprising a mine roof support assembly and apparatus for drilling bores, the roof support assembly comprising a plurality of roof support units positioned side-by-side, and the drilling apparatus comprising a drilling device which is movably guided on a track associated with the roof support assembly, each of the roof support units having at least one roof bar, wherein the track is arranged on the roof bars of the roof support units, and the drilling device is pivotally mounted on a trolley which is movably guided on the track.

Preferably, the trolley is mounted on a beam which is movably guided on the track, and the beam has a length which is greater than the width of the roof bars of the roof support units.

Advantageously, each of the roof support units has a main roof bar supported on floor-engageable means by hydraulic props, and wherein said roof bars are forward extensions of the main roof bars. Each of said roof bars may be pivotally connected to the front edge of the associated main roof bar. Alternatively, each of said roof bars may be slidably mounted on the associated main roof bar.

Conveniently, each of said roof bars is provided with at least one aperture passing therethrough. These apertures are sized to permit the drill bit of the drilling device to pass therethrough. Advantageously, said apertures widen conically towards the upper surface of said roof bars. The conical formation of the apertures permits the angling of the drill bit, and hence allows angled bores to be drilled.

In a preferred embodiment, the track comprises a plurality of track sections which are joined together end-to-end, each track section extending over a plurality of said roof bars. Advantageously, each pair of adjacent track sections are joined together by means of a respective joint, and wherein at least some of said joints incorporate length-compensation means. Each of the joints incorporating length-compensation means may comprise a pair of guide rails which slidably support the adjacent end portions of the two associated track sections, the adjacent end portions of the guide rails overlapping one another and being pivotally attached to the associated roof bar by means of a pivot joint having a vertical pivot axis. Preferably, the remote ends of the two guide rails of each joint incorporating length-compensation means are attached to the associated roof bar by means of respective resilient pivot joints.

BRIEF DESCRIPTION OF THE DRAWINGS

One form of drilling apparatus constructed in accordance with the invention will now be described, by way of example, with reference to the accompanying drawings, in which.

DESCRIPTION OF PREFERRED EMBODIMENT

Figure 1:
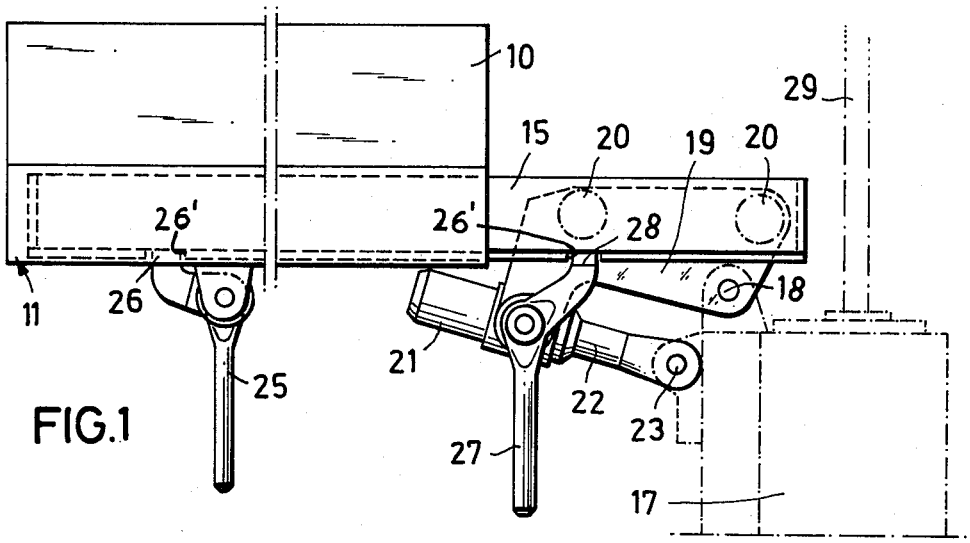
FIG. 1 is a side elevation of the drilling apparatus.
Figure 2:
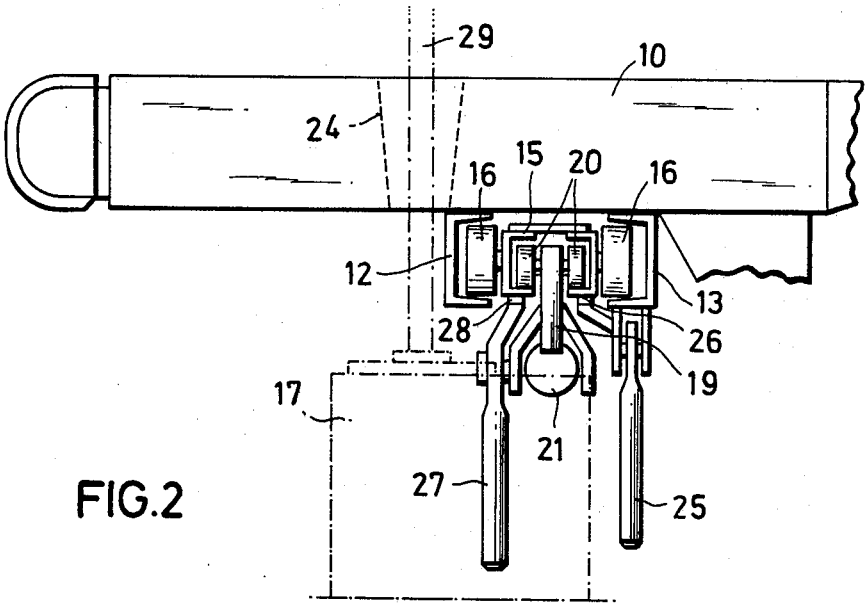
FIG. 2 is an end elevation of the drilling apparatus.

Referring to the drawings, FIGS. 1 and 2 show a drilling apparatus constituted by a track 11 and a drilling device 17. The track 11 is secured to the underneath sides of the roof bars 10 (only one of which is shown) of the roof support units (not shown) of a mine roof support assembly. The roof support assembly is constituted by a plurality of roof support units positioned side-by-side. Each of the roof support units has a main roof bar supported on a floor sill by means of hydraulic props. Each main roof bar has a forward extension roof bar 10 which is pivotally attached to the front edge of the main roof bar. Alternatively, each roof bar 10 is slidably mounted on its respective main roof bar. The track 11 extends along the entire length of the roof support assembly. Where the assembly is used to support the roof a a longwall working, the track 11 is substantially parallel to the longwall face; and, where the assembly is used to support the roof of a mine roadway (or gallery), the track 11 is substantially parallel to the longitudinal axis of the roadway.

As shown in FIG. 2, the track 11 is constituted by a pair of parallel rails 12 and 13 of U-shaped section, the open sides of the U-shaped sections facing one another. A hollow beam 15 is slidably guided by the track 11, the beam being of box-shaped section, and having a slotted base. The sides of the beam 15 are provided with rollers 16 which roll in the U-shaped rails 12 and 13 of the track 11. The beam 15 has a length which is greater than the width of each of the roof bars 10.

The drilling device 17 is suspended from a trolley 19 by means of a pivot joint 18; the trolley passing through the slotted base of the beam 15, and being supported and guided within the beam by mean of two pairs of rollers 20 provided at the sides of the trolley. The axis of the pivot joint 18 extends at right-angles to the longitudinal direction of the track 11, and substantially parallel to the floor of the mine working or roadway. A hydraulic ram 21 is connected between the drilling device 17 and the trolley 19. The pistion rod 22 of the ram 21 is pivotally connected to the drilling device 17 by means of a pivot joint 23. The ram 21 can, therefore, be used to pivot the drilling device 17 about the axis of the pivot joint 18.

In order to drill bores in the roof of the working or roadway, each of the roof bars 10 is provided with at least one aperture 24. As shown in FIG. 2, each of the apertures 24 widens conically towards the upper surface of the associated roof bar 10. The frustoconical shape of the apertures 24 enables bores to be drilled in the roof of the working or roadway at angles other than at right-angles thereto.

The underneath side of the track 11 is provided with a plurality of fixing levers 25 (only one of which can be seen in FIGS. 1 and 2), there being at least one fixing lever associated with each of the roof bars 10. Each fixing lever 25 is provided with a latch 26 which is engageable with one of a series of apertures 26' (two of which are shown in FIG. 1) formed in the base of the beam 15. Thus, the beam 15 can be fixed to the track 11 in any one of a plurality of longitudinally-spaced positions. The apertures 26' are distributed substantially evenly over the length of the beam 15.

A similar fixing lever 27 is pivotally mounted on the trolley 19. The fixing lever 27 is provided with a latch 28 which is engageable with one of the apertures 26' formed in the base of the beam 15. Thus, the trolley 19 can be fixed relative to the beam 15 in any desired position. Thus, by displacement of the beam 15 along the track 11, and/or by displacement of the trolley 19 relative to the beam, it is possible to position the drilling device 17 at any one of a large number of drilling positions spaced along the entire length of the track. The apertures 26' extend across the two elongate flanges forming the slotted base of the beam 15; the fixing levers 25 being associated with one of said flanges, and the fixing lever 27 being associated with the other flange (see FIG. 2).

Accordingly, the drilling device 17 is movable, parallel to the longitudinal direction of the working or roadway, with the aid of the beam 15 and the trolley 19. Because of the provision of the rollers 16 and 20, the drilling device 17 can be moved by hand so there is no need for an external source of propulsion. Bores can be drilled vertically (that is to say at right-angles to the roof of the working or roadway), and at angles of up to about 30° to the vertical, in a vertical plane parallel to the longitudinal axis of the working or roadway. As mentioned above, the drilling angle is adjusted by pivoting the drilling device 17 using the ram 21. The frustoconical shape of each of the apertures 24 guides the drill bit 29 of the drilling device 17 through a given roof bar 10 at the desired angle.

Although not shown, a plurality of drilling devices 17 would be associated with the track 11, so that a relatively large number of bores could be drilled at the same time. Thus, the drilling of bores and fitting of roof anchors can take place simultaneously with the advance of the face of the working or the progress of the roadway.

Figure 3:
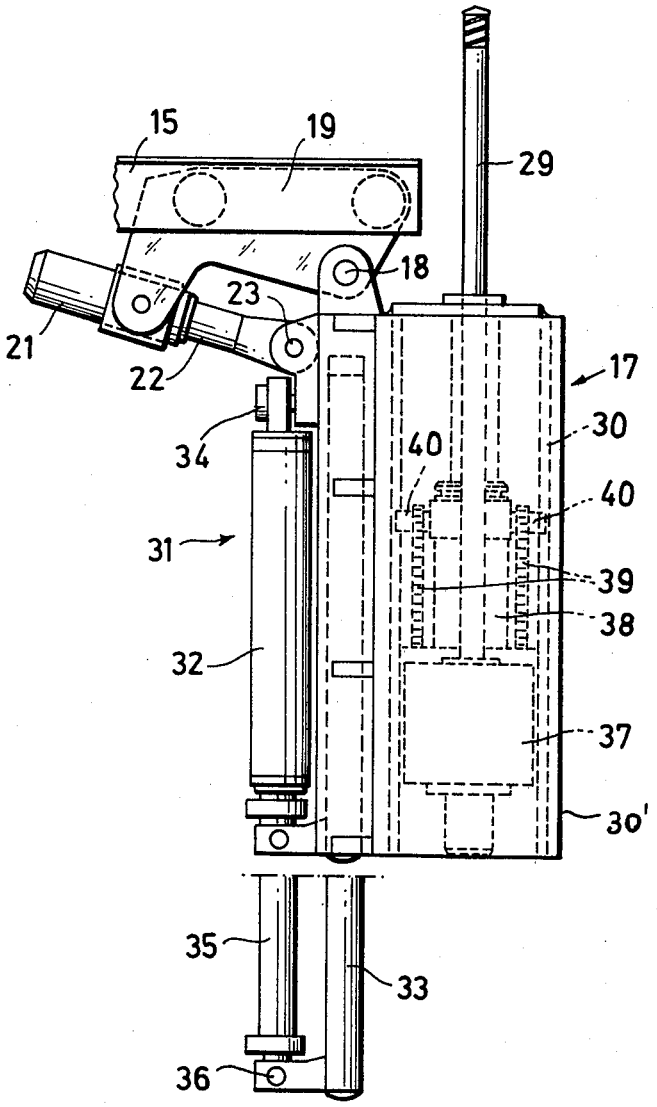
FIG. 3 is an enlarged side elevation of part of the drilling apparatus.

FIG. 3 shows a preferred form of drilling device 17 having a carrier mounting 30 housed within a casing 30'. A support 31 is provided on the outside of the casing 30', the support being constituted by a hydraulic ram having a cylinder 32 and a piston rod 35. The cylinder 32 is attached to the upper portion of the casing 30', and the free end of the piston rod 35 is attached, via a coupling member 36, to a guide rod 33. The guide rod 33 is parallel to the piston rod 35, and is slidably guided within an aperture in the casing 30'. The support 31 is used to provide an abutment for the drilling device 17 against the floor of the working or roadway.

The drilling device 17 is provided with a drill 37 which is guided within the carrier mounting 30 for axial movement, that is to say in the direction of the drill bit advance. The drill 37 is movable to and fro in the axial direction by means of an advance mechanism constituted by a hydraulic ram 38. The ram 38 is arranged parallel to the drill bit 29 and its movable part (either its cylinder or its piston rod) is connected to the casing of the drill 37 by means of a chain drive. The chain drive is constituted by two sprocket chains 39 which pass round pulleys 40 mounted on the movable part of the ram 38, first ends of the chains being attached to the casing of the drill 37, the other ends of the chains being attached to the carrier mounting 30. Thus, when the ram 38 is pressurised, the drill 37 is raised within the carrier mounting 30, so that the drill bit 29 is advanced in the drilling direction. During drilling operations, the drilling device 17 is held in position by the ram 21. The drill 37 incorporates a drive motor.

In order to drill a bore (for example for a roof anchor), the drilling device is brought into the required drilling position and held there by the ram 21. In order to stabilise the drilling device 17 during drilling operations, the piston rod 35 (together with the guide rod 33) is extended against the floor of the working or roadway, so that the drilling device 17 is firmly braced against the floor. After a bore has been drilled, the drill 37 is lowered, using the ram 38, until the drill bit 29 is withdrawn from the associated aperture 26' in the roof bar 10. The support 31 is then lifted away from the floor. The drilling device 17 can then be moved along the track 11 to its next drilling position. After repositioning the drilling device 17, it is re-orientated and braced against the floor, so that the next bore can be drilled.

As can be seen from FIGS. 1 and 3, the beam 15 (and hence the trolley 19), can be located so that the drill bit 29 is positioned laterally of a given roof bar 10. Consequently, the drilling device 17 can be used for drilling bores for gap sealing strips as well as for roof anchors. By pivoting the drilling device 17, using the ram 21, it is also possible to drill bores obliquely into the face of a working or the side wall of a roadway.

Figure 4:
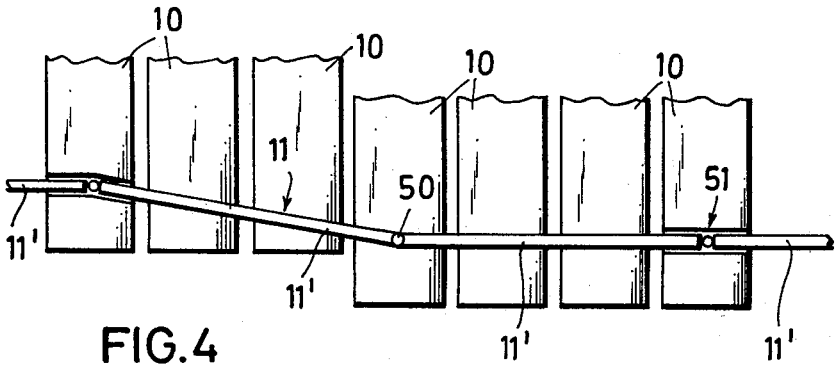
FIG. 4 is an underneath view of parts of the roof bars of a number of roof support units, and shows the track which forms part of the drilling apparatus.
Figure 5:
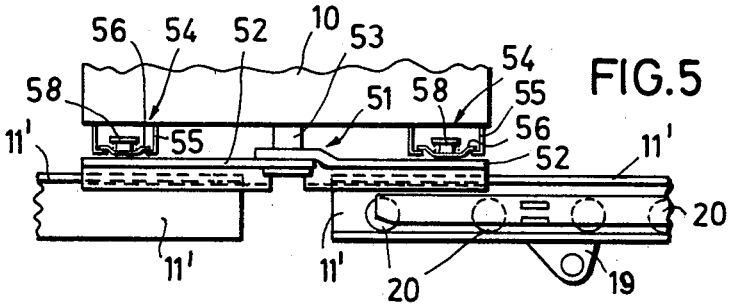
FIG. 5 is a side elevation, on an enlarged scale, of two adjacent sections of the track shown in FIG. 4.
Figure 6:
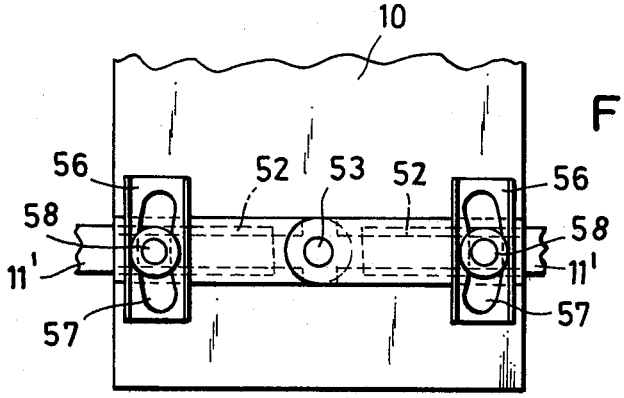
FIG. 6 is an underneath view of the arrangement shown in FIG. 6.

FIGS. 4 to 6 show a preferred form of track 11, the track being secured to the underneath sides of roof bars 10. Each roof bar 10 may be associated with a respective roof support unit. Alternatively, each roof support unit may have two roof bars 10 associated therewith. The track 11 is constituted by a plurality of track sections 11' joined together end-to-end by means of joints 50 and 51. Each of the joints 50 is a pivot joint having a vertical pivot axis (that is to say its pivot axis is at right-angles to the plane of the associated roof bar 10). Each joint 51 is formed with an inbuilt length compensation means (see FIGS. 5 and 6). Thus, each joint 51 is such that the adjacent ends of the two associated track sections 11' are slidably mounted on respective guide rails 52. The guide rails 52 have mutually-overlapping end portions which are suspended, by a common pivot pin 53, from the underneath side of the associated roof bar 10. The other end portions of the guide rails 52 are attached to the underneath side of the roof bar 10 by respective resilient pivot joints 54. Each pivot joint 54 consists of a bracket 55 attached to the underneath side of the roof bar 10, a leaf spring 56 supported by the bracket, and a pivot pin 58. The pivot pin 58 of each pivot joint 54 passes through an arcuate slot 57 formed in the associated leaf spring 56, the widened head of the pivot pin bearing against the upper surface of the leaf spring. The centre point of the arcuate slot 57 lies on the axis of the pivot pin 53.

This form of track 11 permits the roof support units to be advanced individually, without the track being distorted or damaged. This is particularly important where the drilling apparatus is used in conjuction with a roof support assembly positioned in a longwall working, where the individual roof support units are advanced one-by-one to follow up the advance of the longwall face. In this case, the joints 51 are so constructed as to compensate for the changes in track length caused by the length of the working stroke of the hydraulic advance rams (not shown) used to advance the roof support units.

Each track section 11' may extend, for example, over the roof bars 10 of a pair of adjacent roof support units, and each track section may have a pivot joint 50 at one end and a joint 51 at the other end. The resilient pivot joints 54 enable the roof bars 10 to adapt their positions to irregularities in the roof of the working or roadway, without affecting the orientation of the track 11. It is also possible to have more than one track 11 associated with a given roof support assembly, the tracks being joined together end-to-end. In this case, each track should extend over six or more roof support units.

FIG. 5 also shows a modified arrangement, in which the trolley 19 is guided on the track 11 without the interposition of a beam 15. In this case, the trolley 19 is relatively long, and has four rollers 20 on each side. Thus, even where there is a relatively large spacing between the adjacent ends of track sections 11' at a joint 51, the trolley can travel over such a joint.

Although the track arrangement and drilling apparatus described above is intended primarily for use with a roof support assembly for an underground mine working, it can also be used in mine roadways. In either case, the drilling apparatus is usually used for drilling bores in the roof, particularly for positioning roof anchors. However, the pivotal mounting of the drilling device 17 on the trolley 19 permits the drilling device to be pivoted about an axis parallel to the track 11, This enables bores to be drilled in the face of a longwall working, or in the side wall of a roadway. It is also possible to suspend the drilling device 17 from the trolley 19 in such a manner that the drilling device can pivot about a pair of mutually-perpendicular axes (one of which is parallel to the track 11, the other extending towards the face or side wall). Moreover, instead of securing the track 11 to the roof bars 10 which form forward extensions of the main roof bars of the roof support units, the track may be secured to the main roof bars themselves.

We claim:

1. In a mineral mining installation for use in an underground mine, the installation comprising a mine roof support assembly and apparatus for drilling bores, the roof support assembly comprising a plurality of roof support units positioned side-by-side, each of the roof support units having at least one roof bar, the improvement comprising an elongated track arranged on the roof bars of the roof support units, an elongated beam mounted on and movable along the length of the track, a trolley mounted on and movable along the length of the beam, said drilling apparatus comprising a drilling device which is pivotally mounted on said trolley, and means for releasably securing said beam at selected locations along said track and for releasably securing said trolley at selected locations along said beam.

2. Drilling apparatus according to claim 1, wherein the drilling device is pivotally mounted on the trolley for pivotal movement about an axis which extends at right-angles to the longitudinal direction of the track and in the plane of the track.

3. Drilling apparatus according to claim 1, wherein the drilling device is pivotally mounted on the trolley for pivotal movement about an axis which is parallel to the longitudinal axis of the track.

4. Drilling apparatus according to claim 1, wherein the drilling device is pivotally mounted on the trolley for pivotal movement about an axis which is parallel to the longitudinal axis of the track, and for pivotal movement about an axis which lies at right-angles to said longitudinal axis and in the plane of the track.

5. Drilling apparatus according to claim 1, wherein the beam is provided with rollers for movably guiding the beam on the track.

6. Drilling apparatus according to claim 5, wherein the beam is of hollow box-shape construction, the base of which is formed with a longitudinally-extending slot, and wherein the trolley is provided with rollers which rollingly engage with the internal surface of the slotted base of the beam, whereby the trolley is movable relative to the beam.

7. Drilling apparatus according to claim 1, wherein means are provided for adjusting the position of the drilling device relative to the trolley.

8. Drilling apparatus according to claim 7, wherein a hydraulic ram pivotally mounted between the trolley and the drilling device comprises said adjusting means.

9. Drilling apparatus according to claim 1, wherein respective securing devices are provided for securing the trolley to the beam, and for securing the beam to the track.

10. Drilling apparatus according to claim 1, wherein the drilling device is provided with a support which is extensible so as to contact the mine floor, thereby providing an abutment for the drilling device.

11. Drilling apparatus according to claim 1, wherein the drilling device comprises a casing, a carrier mounting within the casing, a drill mounted on the carrier mounting for reciprocal movement therealong and means for moving the drill with respect to the carrier mounting.

12. Drilling apparatus according to claim 11, wherein a hydraulic ram comprises the means for moving the drill with respect to the carrier mounting, said hydraulic ram being arranged within the casing of the drilling device.

13. A mineral mining installation for use in an underground mine, the installation comprising a mine roof support assembly and apparatus for drilling bores, the roof support assembly comprising a plurality of roof support units positioned side-by-side, each of the roof support units having at least one roof bar, an elongated track arranged on the roof bars of the roof support units, an elongated beam mounted on and movable along the length of the track, a trolley mounted on and movable along the length of the beam, said drilling apparatus comprising a drilling device which is pivotally mounted on said trolley, and means for releasably securing said beam at selected locations along said track and for releasably securing said trolley at selected locations along said beam.

14. An installation according to claim 13, wherein the beam has a length which is greater than the width of the roof bars of the roof support units.

15. An installation according to claim 13, wherein each of said roof bars is provided with at least one aperture passing therethrough.

16. An installation according to claim 15, wherein said apertures widen conically towards the upper surface of said roof bars.

17. Apparatus according to claim 13, wherein the track comprises a plurality of track sections which are joined together end-to-end, each track section extending over a plurality of said roof bars.

18. An installation according to claim 17, wherein each pair of adjacent track sections are joined together by means of a respective joint, and wherein at least some of said joints incorporate length-compensation means.

19. An installation according to claim 18, wherein each of the joints incorporating length-compensation means comprises a pair of guide rails which slidably support the adjacent ends of the two associated track sections, the adjacent end portions of the guide rails overlapping one another and being pivotally attached to the associated roof bar by means of a pivot joint having a vertical pivot axis.

20. An installation according to claim 19, wherein the remote ends of the two guide rails of each joint incorporating length-compensation means are attached to the associated roof bar by means of respective resilient pivot joints.

* * * * *